United States Patent [19]

Kurschner

[11] 4,206,451

[45] Jun. 3, 1980

[54] INTRUSION DETECTION SYSTEM

[75] Inventor: Dennis L. Kurschner, Minnetonka, Minn.

[73] Assignee: Honeywell Inc., Minneapolis, Minn.

[21] Appl. No.: 629,172

[22] Filed: Nov. 5, 1975

[51] Int. Cl.[2] ..... G08B 19/00

[52] U.S. Cl. ..... 340/522; 340/551; 340/565; 340/666; 340/38 R

[58] Field of Search ..... 340/258 R, 258 B, 261, 340/522, 551, 565, 666, 38 R; 343/5 PD; 324/3

[56] References Cited

U.S. PATENT DOCUMENTS

| | | | |
|---|---|---|---|
| 3,665,445 | 5/1972 | Riley, Jr. | 340/258 R |
| 3,747,036 | 7/1973 | Erdmann | 336/84 C |
| 3,824,532 | 7/1974 | Vandierendonck | 340/261 |
| 3,885,234 | 5/1975 | Fujimoto | 343/5 PD |

*Primary Examiner*—Theodore M. Blum

*Attorney, Agent, or Firm*—Albin Medved

[57] ABSTRACT

A system for detecting intrusions into a protected area by personnel, vehicles, or other objects, including a sensor capable of detecting magnetic and/or pressure disturbances and a signal processing means for generating an alarm signal when an unwanted intrusion occurs. The signal processing apparatus includes a first band-pass filter for selecting the portion of the signal from the sensor which is within a first frequency range, and a second band-pass filter for selecting a portion of the signal within a second frequency range. Logic circuitry is provided to process the two analog signals from the two band-pass filters using amplitude, signal energy and zero-crossing characteristics of the two signals in a cross-channel relationship to eliminate false alarms which might be caused by disturbances such as lightning, thunder, or wind.

7 Claims, 6 Drawing Figures

INTRUSION DETECTION SYSTEM

BACKGROUND OF THE INVENTION

1. Field of the Invention

The present invention pertains to intrusion detection systems. In particular, the system according to the present invention is intended to detect intrusions across an extended line of many feet in length, such as the perimeter of a restricted area.

2. Description of the Prior Art

Intrusion detection systems utilizing either a series of seismic point sensors or a single magnetic line sensor have been used in the prior art. An example of a system using geophones as seismic point sensors is shown in U.S. Pat. No. 3,818,471, wherein a plurality of geophones are required to define a line across which intrusions are being monitored. Although such systems are useful for some applications, they are not able to distinguish effectively between a valid crossing and signals generated by other disturbances. This inability to adequately distinguish between actual intrusions and other disturbances may result in an undesirably large number of false alarms.

U.S. Pat. No. 3,846,790, discloses an intrusion detection system which utilizes a line sensor capable of detecting both magnetic and seismic disturbances. By using both the magnetic and seismic information from the line sensor, the system is able to decrease the probability of false alarms while at the same time increasing the probability of detecting actual intrusions. While this system is a substantial improvement over the prior art in its ability to decrease the number of false alarms, further improvement for some applications is desirable.

SUMMARY OF THE INVENTION

It is therefore an object of the present invention to provide an improved system for detecting intrusions across a line which is capable, with a high degree of reliability, to differentiate between valid intrusions and signals caused by other disturbances.

An intrusion detection system according to the present invention consists of two major components, a passive line transducer which responds to mechanical and magnetic influences and the electronics to process the transducer signals. The passive line transducer may be of the type disclosed in U.S. Pat. No. 3,747,036, comprising a flexible magnetic core and a segmented sense winding which is wound about the core in such a way as to enhance the detection process for localized magnetic disturbances and to simultaneously provide a first order rejection of non-localized magnetic disturbances (background noise). The electronics module includes a pair of band-pass filters, which separate the transducer signal into two bands for use by the processing logic and amplifies these signals to a usable level. The two analog signals thus generated are processed by logic, using amplitude, signal energy, and zero-crossing characteristics to detect intrusions and to eliminate false alarms.

The transducer is passive and capable of responding to localized mechanical and magnetic influences. The magnetic sensitivity results from flux density changes in the transducer core caused by the presence of a ferro magnetic object, such as a weapon. Because of the earth's field, the core always has a steady-state flux density. Introducing a ferro-magnetic object creates two basic anomalies. The first of these anomalies is permanent magnetism which adds or subtracts flux to the otherwise homogeneous field of the earth. The second anomaly is induced magnetism, in which the intruding object reshapes the flux lines which are a part of the homogeneous field of the earth. A change in the core flux density results in a voltage signal at the output of the transducer.

The localized mechanical sensitivity of the transducer results from the flux density change in the transducer core caused by a stress imparted to the core. The change in the flux density results in a voltage signal at the output of the transducer. The signals generated in response to magnetic and mechanical disturbances are different and independent, thereby providing information as to the nature of the intruding object.

The electronic logic is designed to produce excellent protection under all conditions while rejecting many noise and false alarm sources, such as lightning, wind, electrical interference, etc. The time varying signals from the line transducer are amplified and filtered. A 60 Hz notch filter is provided to remove the 60 cycle noise which abounds whenever the transducer is installed in an area in close proximity to electric power lines. The amplified signal is passed in parallel through two band-pass filters, the first band-pass filter providing a 0.2 to 4 Hz channel and the second band-pass filter providing a 0.2 to 10 Hz channel. The two analog signals appearing at the outputs of the two band-pass filters form the basis of the processing to follow. The logic circuitry which operates on the two analog signals employs four basic principles. First, the signal from the first band-pass filter is used to generate a variable threshold whose value is a function of background noise. Second, the signals from both band-pass filters are used to manipulate control timers which define the logical functions to be performed. Third, the actual detection criteria is established on the basis of energy from the signal generated by the second band-pass filter. And finally, the amount of energy required to detect is a function of the variable threshold and the zero-crossing history of the signal from the second band-pass filter.

DESCRIPTION OF THE PREFERRED EMBODIMENT

Figure 1:
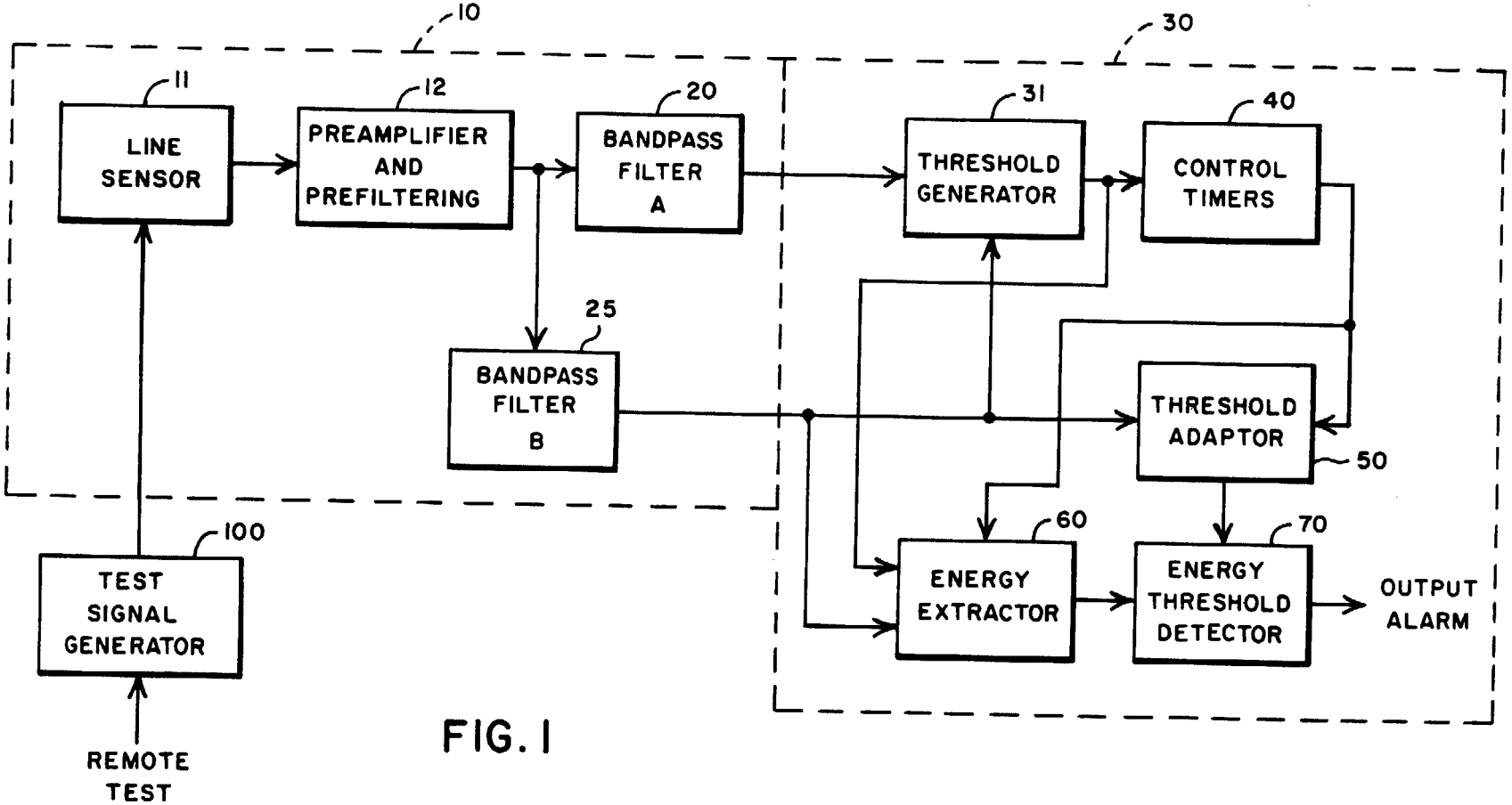
FIG. 1 is a general block diagram of a line intrusion detection system according to the present invention.

The block diagram of FIG. 1 illustrates the intrusion detection system of the present invention in broad terms. The line sensor, which generates the signal for the system, is indicated at numeral 11. The signal from its output is amplified by amplifier 12, the output from which is applied to the inputs of band-pass filters 20 and 25. Band-pass filter 20 selects the portion of the input signal between 0.2 to 10 Hz hereinafter referred to as "signal A", while band-pass filter 24 selects the portion of the signal from 0.2 to 4 Hz hereinafter referred to as "signal B". A threshold generator 31 receives signals A and B from bandpass filters 20 and 25. It generates a threshold signal on the basis of signal A and uses it to compare with signal B. The output signal of threshold generator 31 represents those portions of signal B which exceed the threshold and is used to operate control timers 40. An energy extractor 60 receives inputs from control timers 40, threshold generator 31, and signal B from band-pass filter 25 and provides at its output a signal which represents the amount of energy carried by signal B within a time window allowed by control timers 40 and further meeting the criteria of the threshold level established by threshold generator 31. The signal from the output of energy extractor 60 is applied to the input of an energy threshold detector 70, which provides an alarm output whenever the signal exceeds a second threshold value which is a function of the zero-crossing history of signal B and which is controlled by threshold adapter 50. Threshold adapter 50 receives a signal B from band-pass filter 25 and also the signal from the output of control timers 40 and applies a signal to the input of energy threshold detector 70 to control the threshold level with which the signal from energy extractor 60 is compared. If the signal from energy extractor 60 exceeds the selected threshold, an alarm signal appears at the output of energy threshold detector 70.

A test signal generator 100 is provided, having its input connected to line sensor 11 to simulate an intrusion, and thereby provide a means of testing the proper operation of the system. Further understanding of the operation of the apparatus of FIG. 1 will be gained upon inspection of FIGS. 2 and 4.

Figure 2:
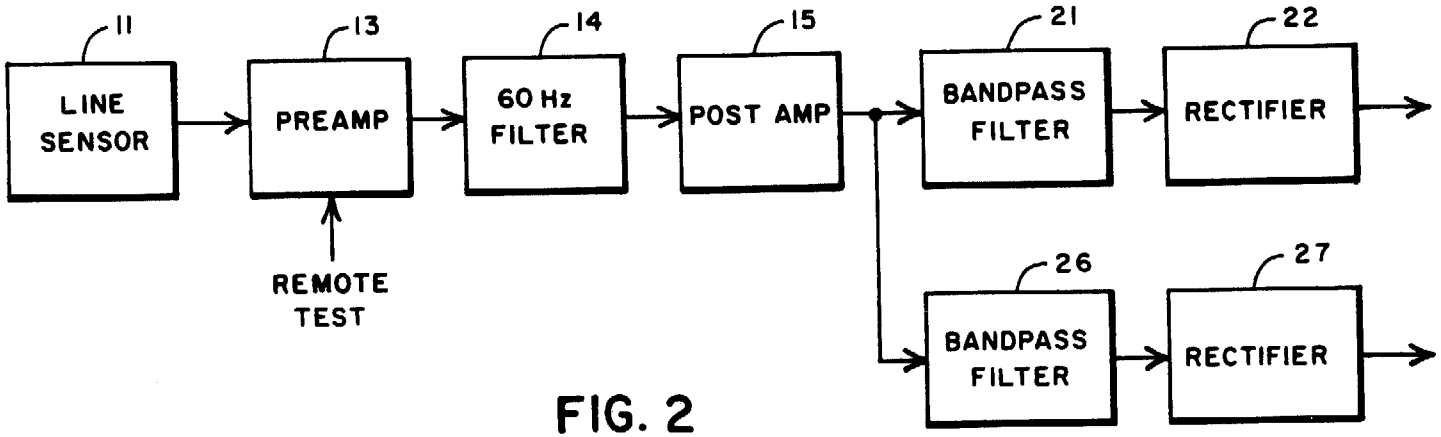
FIG. 2 is a more detailed block diagram of the amplifier and filter portion of the apparatus of FIG. 1.
Figure 3:
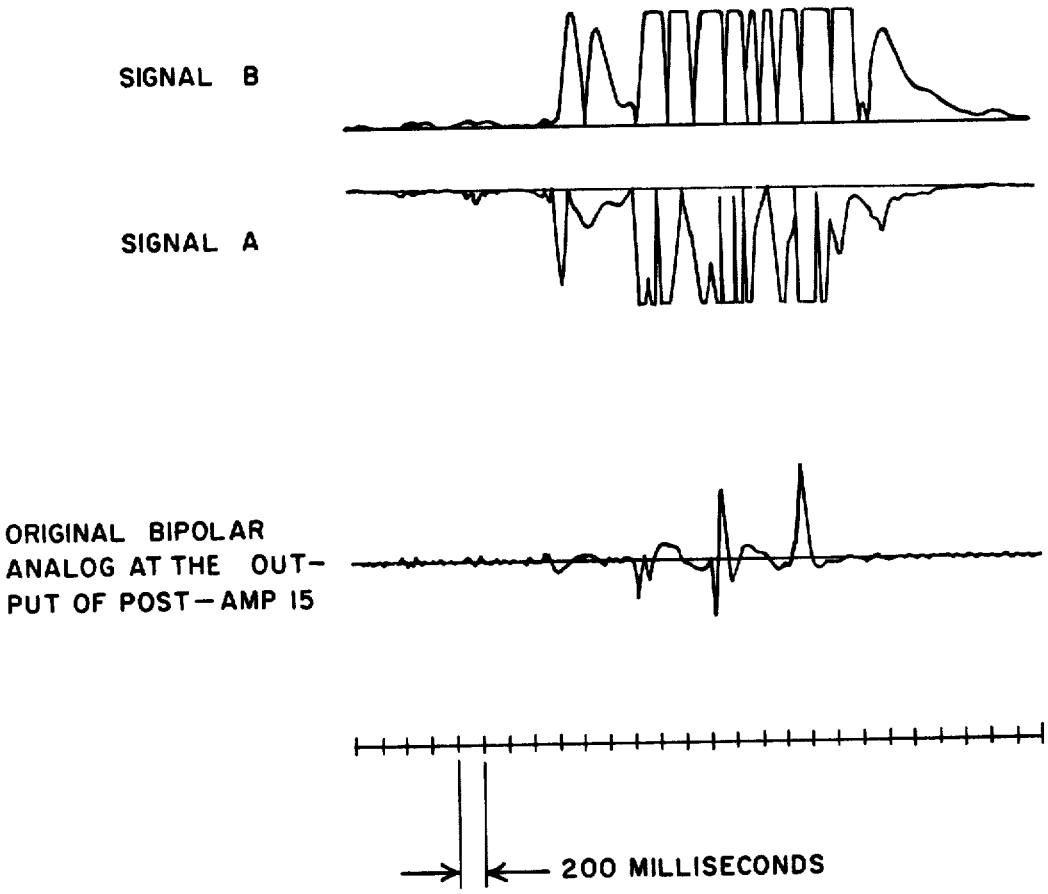
FIG. 3 illustrates typical signals resulting from a one-man intrusion.

FIG. 2 shows in more detail the amplifier and band-pass portion of the apparatus, which in FIG. 1 is identified by reference numeral 10. The signal from the line sensor 11 is preamplified in amplifier 13, the output of which is then applied to a 60 Hz notch filter 14 to remove the 60-cycle which is often picked up by the sensor, particularly if it is located within the vicinity of a power line. The signal from notch filter 14 is then again amplified by an amplifier 15, which may include a gain selector circuit. From the output of amplifier 15, the signal is divided into two paths and is passed through band-pass filters 21 and 26, respectively. Band-pass filter 21 allows the passage of frequencies between 0.2 to 10 Hz while band-pass filter 26 allows the passage of frequencies between 0.2 to 4 Hz. The signal from band-pass filter 21 is passed through a rectifier 22 at whose output appears a rectified signal referred to as "signal A". The signal from band-pass filter 26 is passed through a rectifier 27, at the output of which appears a rectified signal referred to as "signal B". Typical signals resulting from a one-man intrusion are illustrated in FIG. 3.

Figure 4:
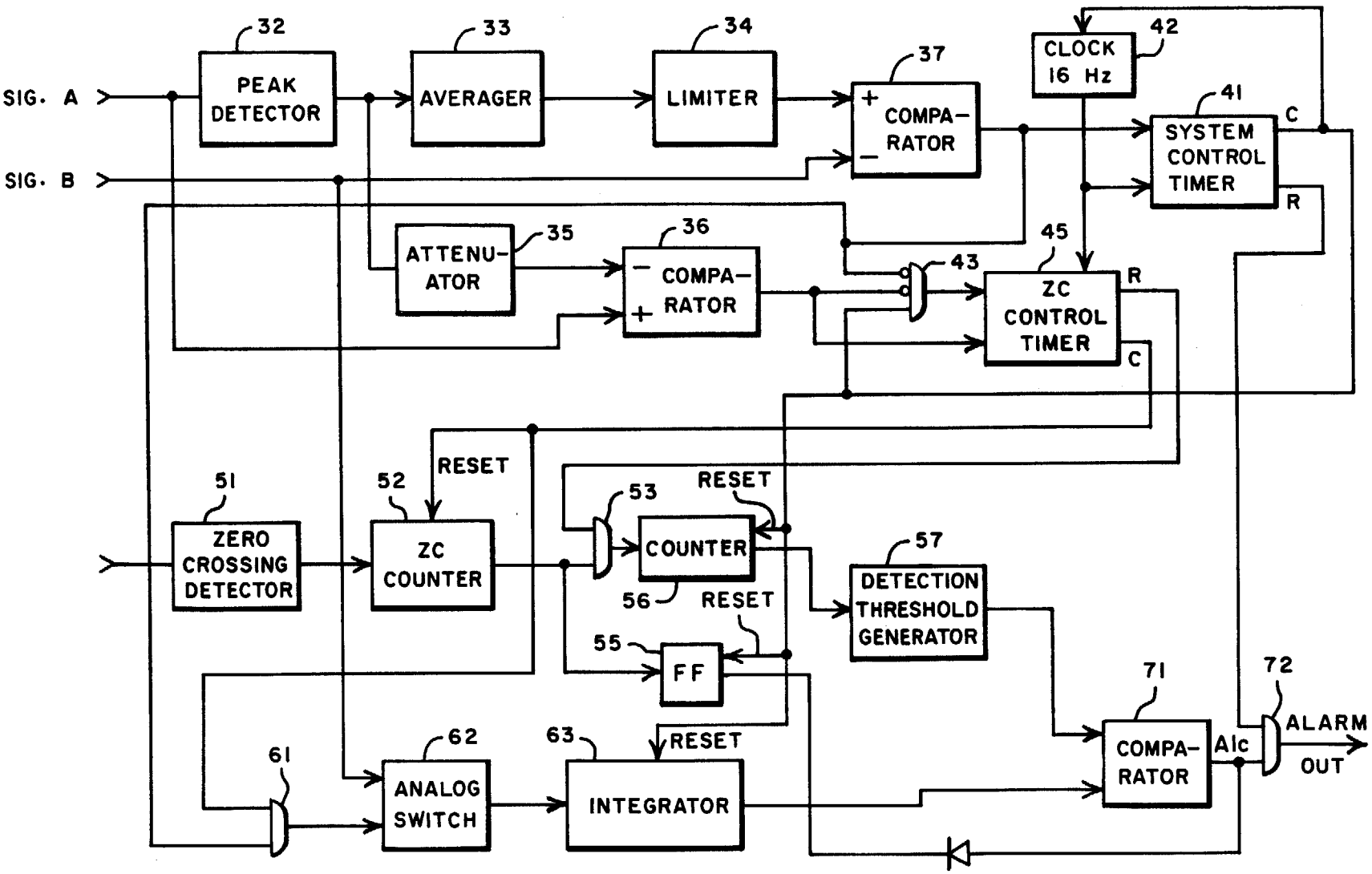
FIG. 4 is a more detailed block diagram of the logic portion of the apparatus of FIG. 1.
Figure 5:
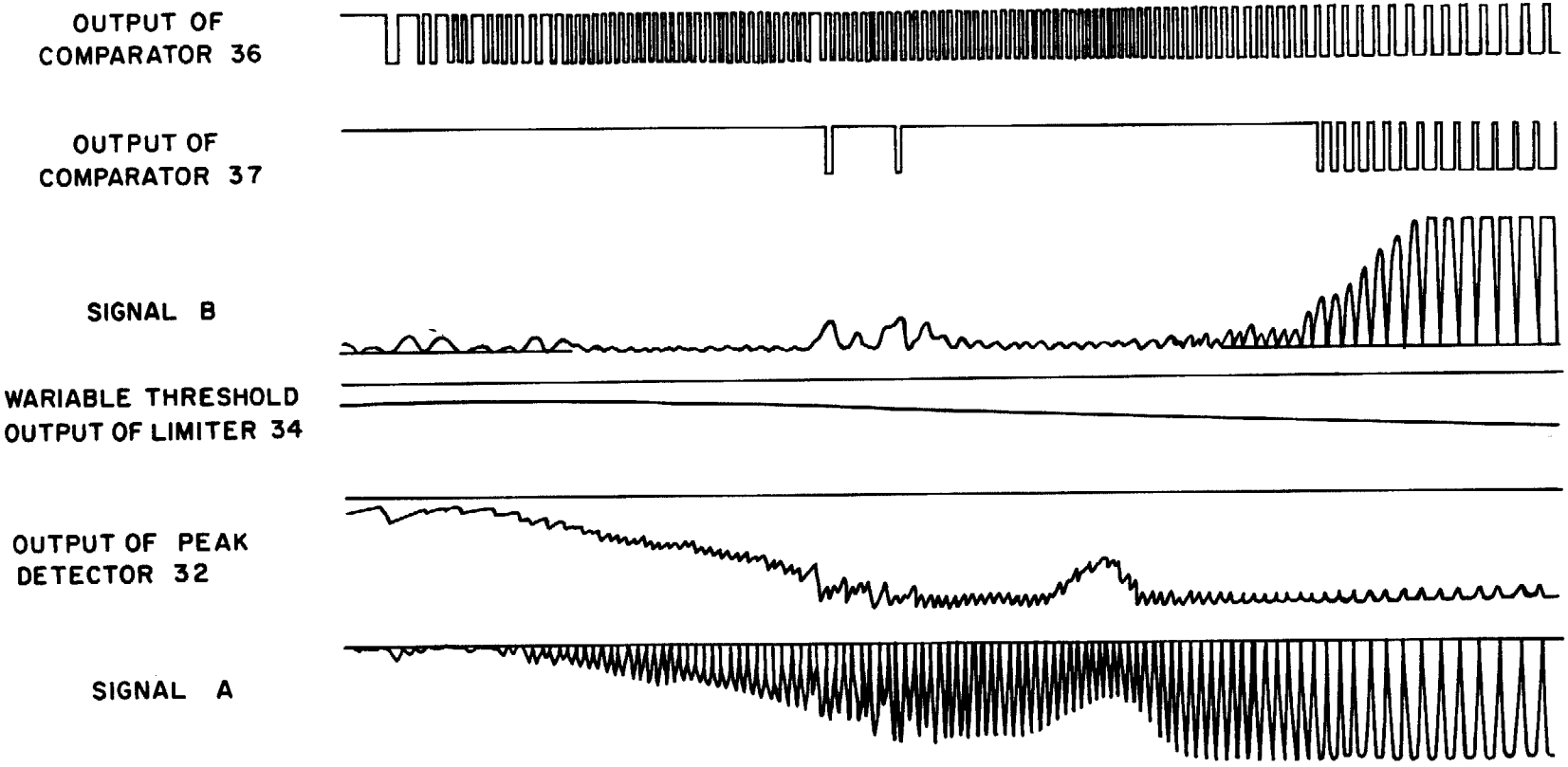
FIG. 5 is a representation of the signals appearing at the various points of the system illustrated in FIGS. 1, 2, and 3.

Signals A and B are processed by the logic circuitry shown in FIG. 4 to determine whether a disturbance is caused by a valid intrusion across the line sensor. A variable threshold is generated by peak detecting signal A and averaging it over a predetermined time constant. The resulting basically DC voltage is then limited to a lower minimum and an upper maximum value. The variable threshold is compared to signal B to obtain an indication when signal B is above or below the threshold. Signal A is applied to the input of a peak detector 32. Peak detector 32 is of the type generally known in the state of the art. The signal at its output follows the input signal when the input signal is rising. When the input signal is dropping, the output of the peak detector decays exponentially, the rate of decay being determined by the time constant selected. A 0.35 second time constant was found experimentally to be suitable in the preferred embodiment. The signal at the output of peak detector 32, as compared to its input, is illustrated in FIG. 5. The bottom trace of FIG. 5 shows a typical signal A, appearing at the input of peak detector 32, and the second trace from the bottom illustrates the corresponding signal appearing at the output of the peak detector. Roughly, the signal at the output of peak detector 32 corresponds to the envelope of signal A. The signal from the output of peak detector 32 is then applied to the input of an averager 33 whose function it is to average the signal over an 18-second time constant. The averaged signal from the output of averager 33 is limited to a lower minimum and an upper maximum value by limiter 34. The output signal of limiter 34 is the variable threshold to which signal B is compared in comparator 37. The signal at the output of comparator 37 is comprised of a series of variable width pulses and is a first control signal for the logic circuitry to follow. A second control signal is generated by attenuating the signal from the output of peak detector 32 in attenuator 35 and comparing it with signal A in comparator 36. In the preferred embodiment, the attenuation factor was 0.9. Typical signals generated by peak detector 32, averager 33, limiter 34, comparator 36, and comparator 37 are illustrated in FIG. 5.

Figure 6:
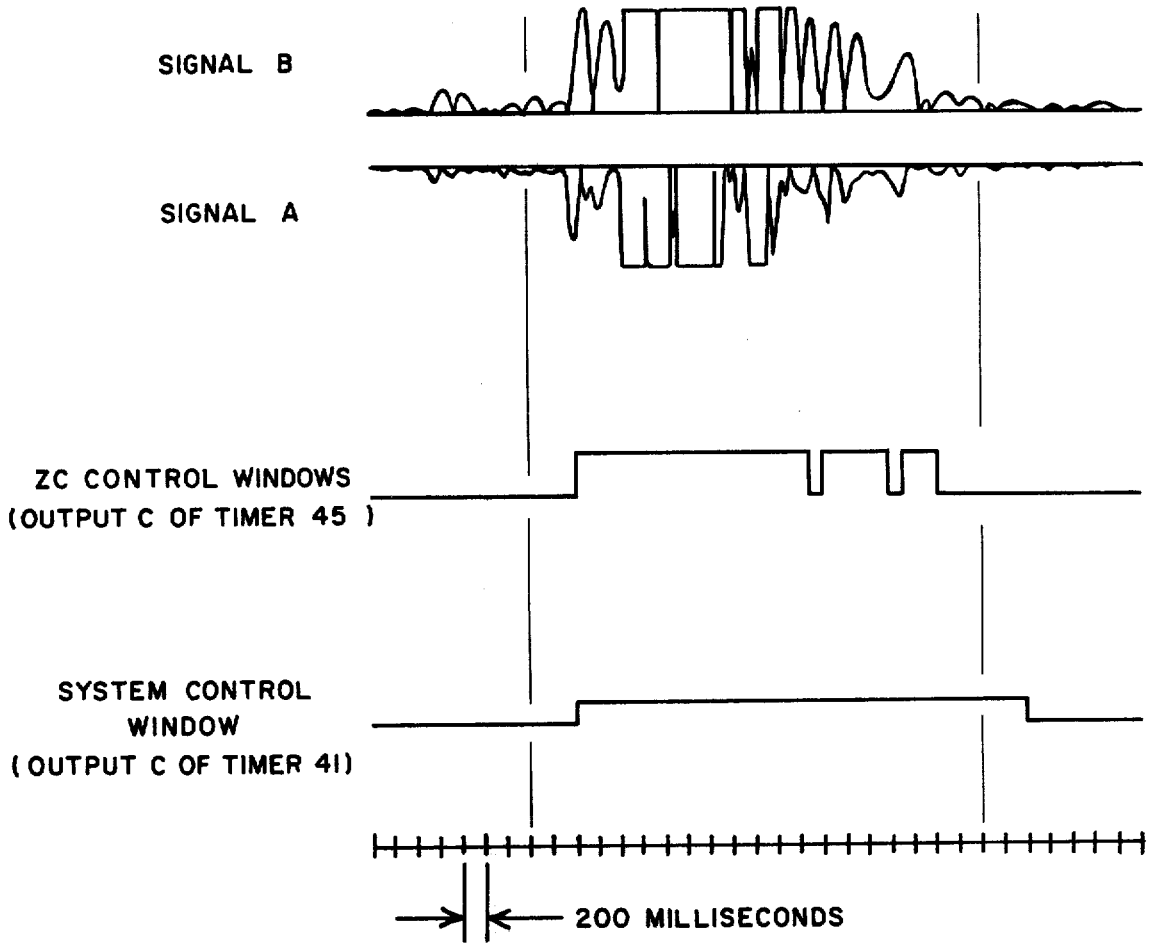
FIG. 6 illustrates typical control timing signals generated by the system control timer and the zero crossing control timer of FIG. 4.

The first control signal from the output of comparator 37 is used to initiate a system control timer 41 and a zero crossing control timer 45. A combination of the first and second control signals provided by comparators 36 and 37 is used to generate two sets of control timing windows at the control (C) outputs of timers 41 and 45, as shown in FIG. 6. The signals in FIG. 6 are for a typical intrusion across the line sensor. The top two traces represent signals A and B. The third trace is the zero crossing control window generated by zero crossing control timer 45. It is initiated by the signal from the output of comparator 37 and is terminated by the signal from the output of comparator 36. The fourth trace is the system control window generated by system control timer 41 at its control output C. It is initiated and terminated by the signal from the output of comparator 37.

A zero crossing control window is generated by zero crossing control timer 45 at its control output C each time a signal is present at the output of comparator 36 and signal B exceeds the threshold, thereby producing an output at comparator 37. Zero crossing control timer 45 is turned off 0.25 seconds after the signal disappears from the output of comparator 36. Zero crossing control timer 45 further has a read output R at which a pulse will be generated by the trailing edge of the zero crossing control window.

The system control window is generated by system control timer 41. It is initiated whenever signal B exceeds the threshold at the output of limiter 34 and is turned off either one second after the signal disappears from the output of comparator 37 or after a five second maximum period. A pulse is generated at read output R of timer 41 at the end of each system control window, but just inside the window. In the example of FIG. 6, the system control window is terminated one second after signal B dropped below the threshold level (the signal disappeared from the output of comparator 37).

A clock 42 is provided, having a frequency of 16 Hz. It is turned on and off by the output of system control timer 41 and it supplies timing pulses to both system control timer 41 and zero crossing control timer 45.

A zero crossing detector 51 receives at its input the unrectified signal from band-pass filter 26 and provides at its output a pulse each time the signal at its input crosses zero. The output of zero crossing detector 51 is applied to the input of a zero crossing counter 52 which provides an output signal whenever the count exceeds one. Counter 52 has a reset input connected to output C of zero crossing control timer 45. It is reset at the end of each zero crossing window. The output of counter 52 is applied to an input of an AND gate 53 and also to the SET input of a flip flop 55. AND gate 53 has a second input connected to the R (read) output of zero crossing control timer 45. The output of AND gate 53 is connected to the input of a counter 56. Flip flop 55 and counter 56 further have RESET inputs connected to output C of system control timer 41 and are reset at the end of each system control window generated by timer 41. Counter 56, like counter 52, provides an output signal whenever the count exceeds one. Counter 56, therefore, will provide an output whenever two or more zero crossings occur in two or more zero crossing control windows within a single system control window. Flip-flop 55, on the other hand, provides an output whenever two or more zero crossings occur in a system control window. The output of counter 56 is applied to the input of a detection threshold generator 57, which provides at its output a DC signal having one of two values, depending on whether a signal is present at its input. A lower amplitude threshold signal will be generated by detection threshold generator 57 when it receives a signal from the output of counter 56. A higher amplitude threshold signal will be generated at other times. Detection threshold generator 57, therefore, may be simply a device for switching its output between two DC voltage levels. A third, yet higher threshold level is provided by the signal from the output of flip-flop 55, which is used, as will be described later, to disable the operation of the alarm output unless at least two zero crossings occur within at least one zero crossing control window in a system control window. The detection threshold is moved up or down according to the prevailing conditions, thereby eliminating the majority of false alarm signals, particularly those caused by lightning, while maintaining sensitive detection. Within each zero crossing control window, generated by zero crossing control timer 45, unrectified signal B (from band-pass filter 26 of FIG. 2) is inspected for zero crossings and a count is tabulated. The history of those counts determines where the detection threshold will be at the end of the time determined by the system control window generated by system control timer 41. In the preferred embodiment, the criteria were set as follows:

| Category | Number of Zero Crossings in a Zero Crossing Window | Number of Zero Crossing Windows in a System Control Window | Threshold Signal Level |
|---|---|---|---|
| 1 | 0 or 1 | 1 | high |
| 2 | 0 or 1 | >1 | high |
| 3 | >1 | 1 | medium |
| 4 | >1 | >1 | low |

Experience has shown that lightning is consistently in categories 1 and 2, a normal intrusion typically falls into the third category, and a sneaking intruder, attempting to avoid detection, usually falls into the fourth category.

The signals from the output of comparator 37 and output C of zero crossing control timer 45 are combined in an AND gate 61, the output of which is connected to a control input of an analog switch 62. Analog switch 62 further has a signal input which is connected to receive signal B. Analog switch 62 acts as a transmission gate, allowing signal B to pass through to its output whenever a signal is present at its control input, while blocking the passage of signal B at other times. Signal B will, therefore, appear at the output of analog switch 62 whenever signal B exceeds the variable threshold and is within a zero crossing window. The signal from the output of analog switch 62 is applied to the input of an integrator 63, which further has a reset input connected to output C of system control timer 41. The output of integrator 63 is a signal whose amplitude is a function of the signal B energy within the zero crossing windows of each system control window.

The signal from the output of integrator 63 is then compared to the threshold signal appearing at the output of detection threshold generator 57. The two signals are compared in comparator 71 and, if the output of integrator 63 exceeds the threshold, a signal appears at the output of comparator 71. This signal from the output of comparator 71 is applied to a first input of an AND gate 72. The output of comparator 71 is also connected, through a diode, to the output of flip-flop 55 which is normally low. It will, therefore, prevent the operation of AND gate 72, except when flip-flop 55 is set by the output of zero-crossing counter 52. As mentioned previously, therefore, no alarm output is possible until at least two zero crossings occur within at least one zero crossing control window in a system control window. AND gate 72 has a second input connected to receive the signal from the output of system control timer 41. An alarm output signal appears at the output of AND gate 72.

The above specification describes the preferred embodiment of the present invention. Clearly, many modifications and variations are possible, without departing from the scope and the spirit of the invention, as will be apparent to those skilled in the art.

What is claimed is:

1. An intrusion detection system comprising:

a line sensor responsive to magnetic and pressure disturbances and generating an output signal which is a function of such disturbances;

a first band-pass filter for receiving the signal generated by said line sensor and selecting and passing to its output portion of said signal within a first frequency range;

a second band-pass filter for receiving the signal generated by said line sensor and selecting and passing to its output the portion of said signal within a second frequency range;

means for generating a first threshold signal as a function of the signal at the output of said first band-pass filter;

means for generating a second threshold signal as a function of the number of zero crossings in the signal from said second band-pass filter;

means for comparing the signal from said second band-pass filter to said first threshold signal;

means for integrating the signal from said second band-pass filter when said signal exceeds said first threshold signal;

means for comparing the integral of said signal from said second band-pass filter to said second threshold signal; and means for generating an alarm output when said integral of said signal from said second band-pass filter exceeds said second threshold signal.

2. An intrusion detection system comprising:

a line sensor responsive to magnetic and pressure disturbances and providing an output signal which is a function of such disturbances;

means for generating a first analog signal which is a portion of the signal provided by said line sensor within a first frequency range;

means for generating a second analog signal which is a portion of said signal provided by said line sensor within a second frequency range;

means for generating a first control signal as a function of said first and second analog signals;

means for generating a second control signal as a function of said first analog signal;

means for generating a system control time window as a function of said first control signal;

means for generating a zero crossing control time window as a function of said first and second control signals;

means for detecting the zero crossings in said second analog signal;

means for generating a detection threshold signal as a function of said zero crossings of said second analog signal, said system control time window, and said zero crossing control time window;

means for integrating the portions of said second analog signal appearing within zero crossing control time windows in each system control time window;

means for comparing the integral of said second analog signal to said detection threshold signal; and means for providing an alarm output signal whenever said integral of said second analog signal exceeds said detection threshold signal.

3. An intrusion detection system as in claim 2, wherein said line sensor has a flexible magnetic core and a sensing winding of conductive wire mounted on said core, said sensing winding being comprised of a plurality of first polarity segments and a corresponding plurality of reversed polarity segments arranged alternately along said core.

4. Apparatus as in claim 2, wherein means for generating said first control signal includes means for generating a first threshold signal as a function of said first analog signal and means for comparing said second analog signal to said first threshold signal.

5. An intrusion detection system as in claim 2, wherein said means for generating said second control signal includes means for peak detecting said first analog signal, multiplying said peak detected signal by a factor of less than one, and comparing the resulting signal with said first analog signal.

6. An intrusion detection system as in claim 2, wherein said means for generating said system control time window includes a system control timer adapted to be initiated by said first control signal and to be terminated by the absence of said first control signal for a first predetermined period of time or by presence of said first control signal for a second longer predetermined period of time, whichever occurs first.

7. An intrusion detection system as in claim 2, wherein said means for generating said zero crossing control time window includes a zero crossing control timer initiated by the simultaneous presence of first and second control signals within a system control time window and terminated by the absence of said second control signal for a predetermined period of time.

* * * * *